US010935332B2

(12) United States Patent
Manay

(10) Patent No.: US 10,935,332 B2
(45) Date of Patent: Mar. 2, 2021

(54) FLUID FLOW GUIDE INSERT FOR HEAT EXCHANGER TUBES

(71) Applicant: Rheem Manufacturing Company, Atlanta, GA (US)

(72) Inventor: Atilhan Manay, Roswell, GA (US)

(73) Assignee: Rheem Manufacturing Company, Atlanta, GA (US)

( * ) Notice: Subject to any disclaimer, the term of this patent is extended or adjusted under 35 U.S.C. 154(b) by 85 days.

(21) Appl. No.: 16/059,955

(22) Filed: Aug. 9, 2018

(65) Prior Publication Data

US 2020/0049432 A1 Feb. 13, 2020

(51) Int. Cl.

| | |
|---|---|
| ***F28F 13/06*** | (2006.01) |
| ***F28D 1/06*** | (2006.01) |
| ***F28D 1/02*** | (2006.01) |
| ***F28D 1/047*** | (2006.01) |

(52) U.S. Cl.

CPC ..... *F28F 13/06* (2013.01); *F28D 1/0233* (2013.01); *F28D 1/06* (2013.01); *F28D 1/0472* (2013.01)

(58) Field of Classification Search

CPC ..... F28F 1/08; F28F 1/40; F28F 1/426; F28F 13/06; F28F 13/12; F28F 13/125; F28F 2220/00; F28F 2250/02; F28F 9/026; F28F 9/028; F28F 9/0282; F28D 1/0213; F28D 1/047; F28D 1/06; F28D 2020/0078; F28D 21/0007; F28D 21/0014; F28D 2021/0056; F16L 55/1286; F16L 55/02772

See application file for complete search history.

(56) References Cited

U.S. PATENT DOCUMENTS

| | | | | | |
|---|---|---|---|---|---|
| 1,961,907 | A | * | 6/1934 | Mott | F28D 7/12 165/146 |
| 2,983,261 | A | * | 5/1961 | Smith | F24H 1/30 122/155.1 |
| 3,394,736 | A | * | 7/1968 | Pearson | F28F 1/40 138/38 |
| 3,889,746 | A | * | 6/1975 | Laffranchi | F28D 7/103 165/155 |
| 4,296,539 | A | * | 10/1981 | Asami | F16L 9/19 165/115 |
| 4,395,210 | A | * | 7/1983 | Hama | B29C 48/301 425/71 |
| 4,493,368 | A | | 1/1985 | Gronnerud et al. | |

(Continued)

FOREIGN PATENT DOCUMENTS

| | | | | |
|---|---|---|---|---|
| CN | 201955009 | | 8/2011 | |
| JP | 11351696 | A * | 12/1999 | F28F 1/08 |
| KR | 20130117043 | | 10/2013 | |

OTHER PUBLICATIONS

JP-11351696-A—English machine translation (Year: 1999).*

*Primary Examiner* — Jianying C Atkisson
*Assistant Examiner* — Jose O Class-Quinones
(74) *Attorney, Agent, or Firm* — Troutman Pepper Hamilton Sanders LLP

(57) ABSTRACT

A heat exchanger tube insert for use in a heat exchanger tube located within a fuel fired apparatus or non-fired storage tank heat exchanger. The heat exchanger tube insert includes a central rode, a cap, and at least two protruding helical guides that are configured to direct a flow of heated working fluid around the inner circumference of the heat exchanger tube.

19 Claims, 5 Drawing Sheets

(56) References Cited

U.S. PATENT DOCUMENTS 4,534,409 A * 8/1985 Cadars ..... F28F 13/12 138/38
4,823,864 A 4/1989 Hughes
4,823,865 A * 4/1989 Hughes ..... F28F 13/12 138/38
4,869,230 A * 9/1989 Fletcher ..... F23C 3/002 126/91 A
4,960,078 A * 10/1990 Yokoyama ..... F23C 15/00 122/24
5,044,930 A * 9/1991 Hongo ..... F23C 6/02 431/1
5,094,224 A * 3/1992 Diesch ..... F28F 1/42 126/110 R
5,222,476 A * 6/1993 Chmielewski ..... F23C 3/002 126/110 C
5,271,376 A * 12/1993 Lu ..... F24H 3/105 126/110 R
5,341,770 A * 8/1994 Lannes ..... F24H 9/0042 122/19.2
5,365,891 A * 11/1994 Hanning ..... F24H 9/0042 122/19.1
5,649,529 A * 7/1997 Lu ..... F23M 9/06 126/110 R
5,791,298 A * 8/1998 Rodgers ..... F23D 14/105 122/14.21
5,839,505 A * 11/1998 Ludwig ..... F28D 1/0477 165/109.1
6,688,378 B2 * 2/2004 O'Donnell ..... F24H 9/0026 138/40
8,459,342 B2 * 6/2013 O'Donnell ..... F24H 3/087 165/109.1
8,540,011 B2 9/2013 Wang et al.
2005/0161209 A1 * 7/2005 Havard, Jr. ..... F24H 3/087 165/177
2010/0173255 A1 * 7/2010 Reifel ..... F23C 3/004 431/350
2012/0292000 A1 * 11/2012 Khan ..... F28F 13/12 165/109.1
2013/0175017 A1 * 7/2013 Goto ..... B21D 11/14 165/181
2015/0107806 A1 * 4/2015 Glass ..... F28F 1/003 165/154

* cited by examiner

FLUID FLOW GUIDE INSERT FOR HEAT EXCHANGER TUBES

TECHNICAL FIELD

Embodiments described herein relate generally to inserts for heat exchanger (HX) tubes, and more particularly to a fluid flow guide which is inserted in a HX tube that increases the residence time and fluid contact area within a HX tube without the need of inducing turbulence.

BACKGROUND

Heat exchangers, such as ones used in heating, ventilation, water heaters and air conditioning (HVAC) systems, and other similar devices (generally called heat exchangers) control or alter thermal properties of one or more fluids, such as air or water. In some cases, tubes (also called heat exchanger tubes or HX tubes) disposed within these devices transfer a working fluid through the HX tubes that is at a different thermal condition from a fluid outside the HX tubes, thereby altering the thermal properties of the working fluid within the HX tubes and the outside fluid, such as air, passing over the outside of the HX tubes. The temperature of the working fluid and the outside fluid passing over the outside of the HX tubes can increase or decrease, depending on how the device is configured. The working fluid and the outside fluid do not mix. There have been many approaches to increase the thermal efficiency of the HX tube that in turn increase the efficiency of the device, since the overall thermal efficiency of the device depends on both the working fluid and outside fluid.

One approach to increase thermal efficiency of the HX tube is to enhance the turbulence of working fluid inside the HX tube by adding baffles or turbulators inside the HX tube. In another approach, the HX tube has multiple dimple like deformations on the HX tube surface to increase velocity of the working fluid at the deformations, thus increasing the turbulence.

This disclosure takes an alternate route to increase efficiency and heat exchange within a HX tube. The HX tube insert described here increases the residence time of working fluid flow through the HX tube and also increases working fluid contact time on the inner circumference of the HX tube, thereby increasing efficiency. The HX tube insert can increase performance while still limiting the pressure drop to within application limits of standard combustion systems.

SUMMARY

In general, in one aspect, the disclosure relates to a HX tube insert for a thermal transfer device, such as a heat exchanger within an HVAC, boiler, or a water heater. A general embodiment of the disclosure is a heat exchanger tube comprising: a heat exchanger tube insert positioned within the heat exchanger tube, wherein the heat exchanger tube insert comprises: a central rod, a cap covering one end of the central rod; and a protruding guide positioned helically around an outer surface of the central rod and extending a full width of an annulus between the central rod and an inner surface of the heat exchanger tube. In embodiments, the heat exchanger tube insert can comprise two, three, four, five or six protruding guides. In some embodiments, a length of the heat exchanger tube insert is less than 90%, less than 80%, less than 70%, less than 60%, less than 50%, less than 40%, less than 30%, or less than 20% of a length of the heat exchanger tube. In specific embodiments, the heat exchanger tube comprises dimples along a portion of the heat exchanger tube that does not comprise the heat exchanger tube insert. the protruding guide can be integral to the heat exchanger tube insert or the protruding guide can be attached to the heat exchanger tube insert. The cap can be integral to the central rod or extrinsic to the central rod (such as by an attachment). In some embodiments, the central rod is greater than half an inner diameter of the heat exchanger tube.

Another general embodiment is a fuel-fired water heater comprising: a water tank; a burner assembly configured to generate a heated working fluid; a heat exchanger positioned in the water tank, the heat exchanger comprising a heat exchanger tube, wherein the heat exchanger tube is configured to receive the heated working fluid from the burner assembly, and a heat exchanger tube insert positioned within the heat exchanger tube comprising a central rod, a cap covering one end of the central rod, and a protruding guide positioned helically along an outside of the central rod and which extends a full width of an annulus between the central rod and an inner surface of the heat exchanger tube; and an exhaust configured to receive the heated working fluid from the heat exchanger tube. In some embodiments, the cap of the central rod is located on an end of the central rod which is closest to the burner assembly. In some embodiments, a length of the central rod is less than 90%, less than 80%, less than 70%, less than 60%, less than 50%, less than 40%, less than 30%, or less than 20% of a length of the heat exchanger tube. The central rod can be positioned within the heat exchanger such that one end of the central rod abuts an end of the heat exchanger tube which is closest to the exhaust. In some embodiments, a length of the heat exchanger insert is less than the length of the heat exchanger tube minus five times the diameter of the length of the heat exchanger tube. In embodiments, the heat exchanger tube insert can comprise two, three, four, five or six protruding guides. In specific embodiments, the heat exchanger tube comprises dimples along a portion of the heat exchanger tube that does not comprise the heat exchanger tube insert. The protruding guide can be integral to the heat exchanger tube insert or the protruding guide can be attached to the heat exchanger tube insert. The cap can be integral to the central rod or extrinsic to the central rod (such as by an attachment). In some embodiments, the central rod is greater than half an inner diameter of the heat exchanger tube.

Another general embodiment of the disclosure is a fuel-fired furnace comprising: a fuel source; a burner assembly configured to generate a heated working fluid; a heat exchanger comprising a heat exchanger tube, wherein the heat exchanger tube is configured to receive the heated working fluid from the burner assembly, and a heat exchanger insert positioned within the heat exchanger tube comprising a central rod, a cap covering one end of the central rod, and a protruding guide positioned helically along the outside of the central rod and extending a full width of an annulus between the central rod and an inner surface of the heat exchanger tube; a fan positioned to move air over an outer surface of the heat exchanger tube; and an exhaust configured to receive the heated working fluid from the heat exchanger tube. In some embodiments, the cap of the central rod is located on an end of the central rod which is closest to the burner assembly. In some embodiments, the length of the central rod is less than 90%, less than 80%, less than 70%, less than 60%, less than 50%, less than 40%, less than 30%, or less than 20% of a length of the heat exchanger tube. In some embodiments, the central rod is positioned within the heat exchanger such that one end of the central rod abuts an end of the heat exchanger tube which is closest to the exhaust. The length of the heat exchanger insert can be less than the length of the heat exchanger tube minus five times the diameter of the length of the heat exchanger tube. In some embodiments the heat exchanger insert comprises a plurality of protruding guides positioned helically along the outside surface of the central rod. In embodiments, the heat exchanger tube insert can comprise two, three, four, five or six protruding guides. In specific embodiments, the heat exchanger tube comprises dimples along a portion of the heat exchanger tube that does not comprise the heat exchanger tube insert. The protruding guide can be integral to the heat exchanger tube insert or the protruding guide can be attached to the heat exchanger tube insert. The cap can be integral to the central rod or extrinsic to the central rod (such as by an attachment). In some embodiments, the central rod is greater than half an inner diameter of the heat exchanger tube.

Another general embodiment of the disclosure is a non-fired heat exchanger comprising a heat exchanger tube, wherein a heat exchanger tube insert is positioned within the heat exchanger tube, wherein the heat exchanger tube insert comprises: a central rod, a cap covering one end of the central rod; and a protruding guide positioned helically around an outer surface of the central rod and extending a full width of an annulus between the central rod and an inner surface of the heat exchanger tube. In embodiments, the heat exchanger tube insert can comprise two, three, four, five or six protruding guides. In some embodiments, a length of the heat exchanger tube insert is less than 90%, less than 80%, less than 70%, less than 60%, less than 50%, less than 40%, less than 30%, or less than 20% of a length of the heat exchanger tube. In specific embodiments, the heat exchanger tube comprises dimples along a portion of the heat exchanger tube that does not comprise the heat exchanger tube insert. The protruding guide can be integral to the heat exchanger tube insert or the protruding guide can be attached to the heat exchanger tube insert. The cap can be integral to the central rod or extrinsic to the central rod (such as by an attachment). In some embodiments, the central rod is greater than half an inner diameter of the heat exchanger tube. In one embodiment, the non-fired heat exchanger is a coil heated thermal storage tank.

These and other aspects, objects, features, and embodiments will be apparent from the following description and the appended claims.

BRIEF DESCRIPTION OF THE DRAWINGS

The drawings illustrate only example embodiments of HX tube inserts and HX tube assembly configurations within systems and are therefore not to be considered limiting in scope, as HX tube inserts and tube assembly configurations may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DETAILED DESCRIPTION OF EXAMPLE EMBODIMENTS

Figure 1:
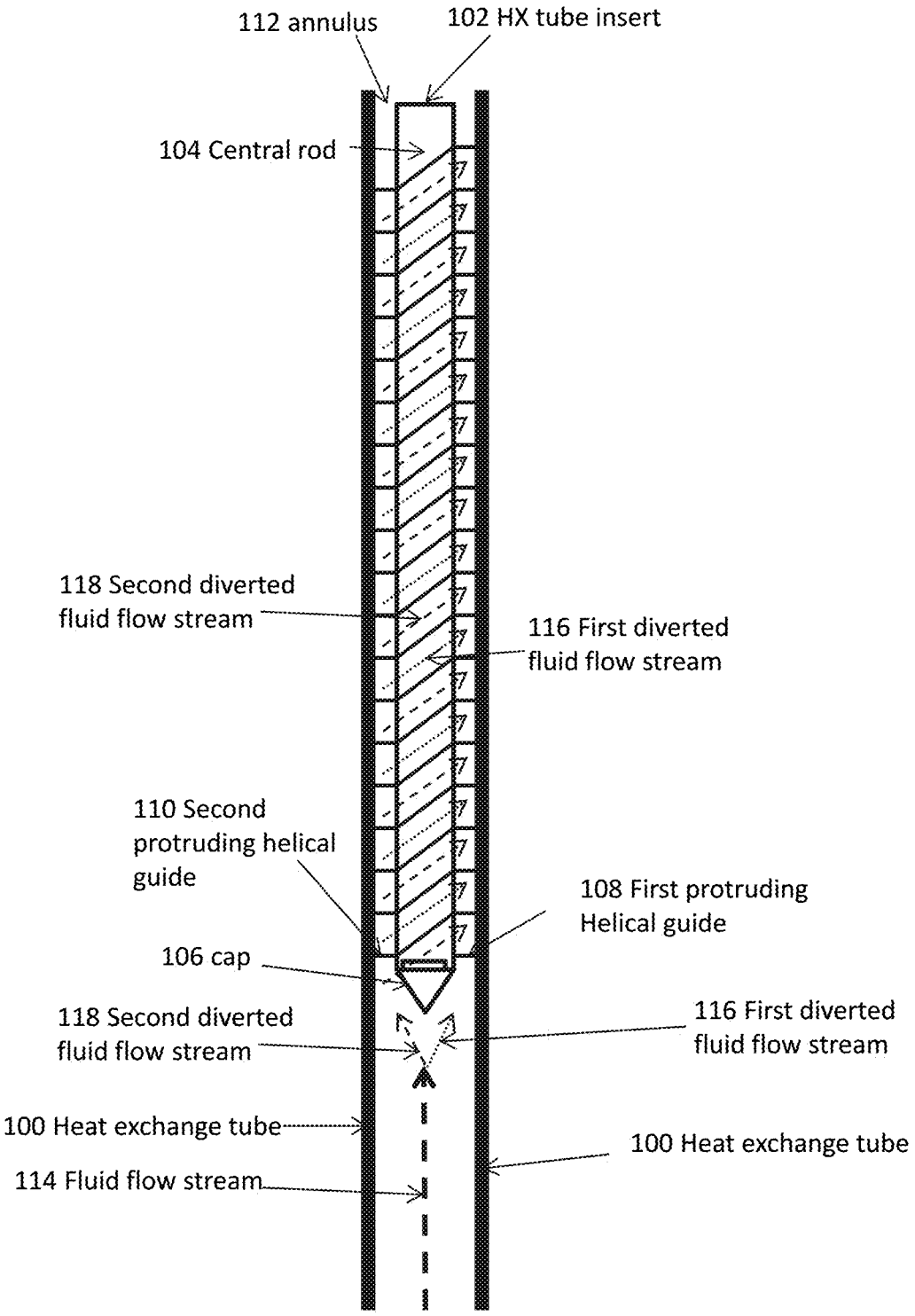
FIG. 1 illustrates a cross section of a HX tube with a HX tube insert installed.

The example embodiments discussed herein are directed to systems, methods, and devices for HX tube inserts and HX tube assembly configurations within a heat exchanger. Example embodiments can be directed to any of a number of thermal transfer devices, including but not limited to heat exchangers used in water heaters and HVAC systems.

Example embodiments can be pre-fabricated or specifically generated (e.g., by shaping a malleable body) for a particular heat exchanger and/or environment. Example embodiments can have standard or customized features (e.g., shape, size, number of helixes, features on the inner surface, pattern, configuration). Therefore, the example embodiments described herein should not be considered limited to creation or assembly at any particular location and/or by any particular person.

The HX tubes (or components thereof) described herein can be made of one or more of a number of suitable materials and/or can be configured in any of a number of ways to allow the HX tubes (or devices (e.g., HVAC systems) in which the HX tubes are disposed) to meet certain standards and/or regulations while also maintaining reliability of the HX tubes, regardless of the one or more conditions under which the HX tubes and HX tube inserts may be exposed. Examples of such materials can include, but are not limited to, alloys of aluminum, stainless steel, or titanium.

As discussed above, heat exchangers can be subject to complying with one or more of a number of standards, codes, regulations, and/or other requirements established and maintained by one or more entities. Examples of such entities can include, but are not limited to, the American Society of Mechanical Engineers (ASME), the Tubular Exchanger Manufacturers Association (TEMA), the American Society of Heating, Refrigeration and Air Conditioning Engineers (ASHRAE), Underwriters' Laboratories (UL), the National Electric Code (NEC), the Institute of Electrical and Electronics Engineers (IEEE), and the National Fire Protection Association (NFPA). Example HX tubes with HX tube inserts allow a heat exchanger to continue complying with such standards, codes, regulations, and/or other requirements. In other words, example HX tubes with HX tube inserts, when used in a heat exchanger, do not compromise compliance of the heat exchanger with any applicable codes and/or standards.

Any example HX tube inserts, or portions thereof, described herein can be made from a single piece (e.g., as from a mold, die cast, 3-D printing process, extrusion process, stamping process, crimping process, and/or other prototype methods). In addition, or in the alternative, example HX tube inserts (or portions thereof) can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

As described herein, a user can be any person who interacts with HX tube inserts, HX tubes or heat exchangers in general. Examples of a user may include, but are not limited to, an engineer, a maintenance technician, a mechanic, an employee, a visitor, an operator, a consultant, a contractor, and a manufacturer's representative.

In general, example embodiments provide systems, methods, and devices for increasing heat exchanger tube efficiency. In some examples, the HX tube could be used in a water heater or a furnace. Example embodiments can be used for any size (e.g., capacity) of water heater, boiler, HVAC system, non-fired heat exchangers such as coil heated thermal storage tanks. Further, example embodiments of water heaters, boilers, and furnaces can be located in any type of environment (e.g., warehouse, attic, garage, storage, mechanical room, basement) for any type (e.g., commercial, residential, industrial) of user. Example water heaters can be used for one or more of any number of processes (e.g., automatic clothes washers, automatic dishwashers, showers, sink faucets, heating systems, humidifiers). Example water heaters and furnaces can be used in commercial and/or residential applications. In embodiments of the disclosure the heat exchanger tube insert is used within a heat exchanger tube located in a heat exchanger in a fuel fired appliance.

Embodiments can be directed to high-efficiency heat exchangers (e.g., water heaters having an efficiency of at least 90%) or can also apply to heat exchangers having lower efficiencies (e.g., 80%). Further, example embodiments can apply to water heaters or furnaces having any of a number of components and/or configurations. Therefore, the components and configurations of water heaters or furnaces shown and described herein are meant merely to be non-limiting examples of appliances that can have increased efficiency using example embodiments.

Water heater systems and/or furnaces (or components thereof, including controllers) described herein can be made of one or more of a number of suitable materials to allow that device and/or other associated components of a system to meet certain standards and/or regulations while also maintaining durability in light of the one or more conditions under which the devices and/or other associated components of the system can be exposed. Examples of such materials can include, but are not limited to, aluminum, stainless steel, copper, fiberglass, glass, plastic, PVC, ceramic, and rubber.

Components of a heat exchangers (or portions thereof) described herein can be made from a single piece (as from a mold, injection mold, die cast, or extrusion process). In addition, or in the alternative, components of a heat exchanger system (or portions thereof) can be made from multiple pieces that are mechanically coupled to each other. In such a case, the multiple pieces can be mechanically coupled to each other using one or more of a number of coupling methods, including but not limited to epoxy, welding, soldering, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

As used herein, a "coupling feature" can couple, secure, fasten, abut, and/or perform other functions aside from merely coupling. A coupling feature as described herein can allow one or more components of a HX tube to become coupled, directly or indirectly, to another portion (e.g., an inner surface) of the HX tube. A coupling feature can include, but is not limited to, a swage, a snap, a clamp, a portion of a hinge, an aperture, a recessed area, a protrusion, a slot, a spring clip, a tab, a detent, a compression fitting, and mating threads. One portion of an example HX tube can be coupled to a component of a heat exchanger and/or another portion of the HX tube by the direct use of one or more coupling features.

As used herein, "HX tube insert" is a fluid flow guide which is inserted into a HX tube. The HX tube insert can but is not required to extend the complete length of a HX tube. In certain embodiments, the length of the HX tube insert is entirely within the HX tube and does not extend beyond the length of the HX tube. In the preferred embodiment, the HX tube insert extends across the entire inner diameter of the HX tube so that working fluid passing along the HX tube insert must follow a path formed by one or more protruding guides of the HX tube insert.

Any component described in one or more figures herein can apply to any other figures having the same label. In other words, the description for any component of a figure can be considered substantially the same as the corresponding component described with respect to another figure. For any figure shown and described herein, one or more of the components may be omitted, added, repeated, and/or substituted. Accordingly, embodiments shown in a particular figure should not be considered limited to the specific arrangements of components shown in such figure.

Example embodiments of HX tube inserts will be described more fully hereinafter with reference to the accompanying drawings, in which example embodiments of HX tubes and HX tube inserts are shown. HX tube inserts may, however, be embodied in many different forms and should not be construed as limited to the example embodiments set forth herein. Rather, these example embodiments are provided so that this disclosure will be thorough and complete, and will fully convey the scope of HX tube inserts to those of ordinary skill in the art. Like, but not necessarily the same, elements (also sometimes called components) in the various figures are denoted by like reference numerals for consistency.

Terms such as "first," "second," "top," "bottom," "left," "right," "end," "back," "front," "side", "length," "width," "inner," "outer," "above", "lower", and "upper" are used merely to distinguish one component (or part of a component or state of a component) from another. Such terms are not meant to denote a preference or a particular orientation unless specified, and are not meant to limit embodiments of HX tubes. Unless otherwise noted, "diameter" refers to the inner diameter of a HX tube. In the following detailed description of the example embodiments, numerous specific details are set forth in order to provide a more thorough understanding of the disclosure. However, it will be apparent to one of ordinary skill in the art that the invention may be practiced without these specific details. In other instances, well-known features have not been described in detail to avoid unnecessarily complicating the description.

FIG. 1 is a cross section illustrating one example of a HX tube 100 with a HX tube insert 102 of the disclosure inserted into the HX tube 100. The HX tube insert 102 comprises a central rod 104, a cap 106, a first protruding helical guide 108, and a second protruding helical guide 110. The first protruding helical guide 108 and the second protruding helical guide 110 are positioned helically along the outside of the central rod 104 and extend the full width of the annulus 112 between the HX tube 100 and the central rod 104. The working fluid flow stream 114 runs within the HX tube 100 towards the cap 106 of the HX tube insert 102. The fluid flow stream 114 is diverted by the cap 106, the first protruding helical guide 108, and the second protruding helical guide 110 such that the working fluid flow stream 114 is divided into a first diverted fluid flow stream 116 (dots) and a second diverted fluid flow steam 118 (dashes). The first diverted fluid flow stream 116 and the second diverted fluid flow stream 118 then flow around the inner surface of the heat exchanger tube 100 in a helical manner through the voids between the protruding helical guides such that the travel length and residence time of the working fluid is extended along the inner surface of the heat exchanger tube 100.

The central rod 104 may be hollow or filled. The diameter of the central rod 104 can be modified for a particular HX system. For example, the diameter of the central rod 104 can be about, but not limited to, a third the diameter of the HX tube 100, half the diameter of the HX tube 100, two thirds the diameter of the HX tube 100, or three fourth the diameter of the HX tube 100. The central rod 104 can be made of the same material as or a different material from the HX tube 100 in which it is installed. In embodiments, the central rod 104 is made of a material that can withstand temperatures of up to 800 degrees F., 900 degrees F., 1000 degrees F., or 1200 degrees F., or more than 2000 degrees F. to withstand the temperatures of the hot working fluid. In embodiments, the material the central rod 104 is made from is metal, alloy, or a nonmetal, as long as the material grade complies with the operating temperature requirements. In some embodiments, the central rod 104 is made of tungsten, dupex stainless steel, 444, 439, 304 stainless steel high temperature alloy, high temperature polymers, or high performance plastics such as PE or PEI. When hollow, the end of the central rod 104 opposite the cap 106 may be open or it may be closed off, such as through the use of an additional cap.

The HX tube insert 102 illustrated in FIG. 1 comprises two protruding helical flow guides; however, additional embodiments of the disclosure include HX tube inserts 102 with one, three, four, five, or six protruding helical flow guides. Additionally, the helical pitch (the height of one complete turn) or angle of the protruding helical flow guides can be modified for a particular HX system. In some embodiments, the helical pitch could about 2% to 800% ϕ of the HX tube 100. In some embodiments, the helical angle can be between 10 degrees and 80 degrees. For example, the helical angle could be between 25-75 degrees or 35-55 degrees. The helical angle is the angle between the helical flow guide an a horizontal plane passing through the central rod 104 and perpendicular to the long vertical axis of the central rod 104. In embodiments, the protruding helical flow guides are placed symmetrically around the central rod 104 of the HX tube insert 102. In some embodiments, the flow guides are placed asymmetrically around the central rod 104 of the HX tube insert 102.

The protruding helical flow guides can be of the same or different material as the central rod 104. In embodiments, the protruding helical flow guides are made of materials that can withstand temperatures of up to 800 degrees F., 900 degrees F., 1000 degrees F., 1200 degrees F., or more than 2000 degrees F. In embodiments, the material the protruding helical flow guides are made from is metal, alloy, or a nonmetal, as long as the material grade complies with the operating temperature requirements. In some embodiments, the protruding helical flow guides are made of tungsten, dupex stainless steel, 444, 439, 304 stainless steel high temperature alloy, high temperature polymers, or high performance plastics such as PE or PEI. The protruding helical flow guides can be intrinsic to the central rod 104. That is, the protruding helical flow guides may be formed from the central rod 104. In other embodiments, the protruding helical flow guides are initially separate from and then attached to the central rod 104. For example, the protruding helical flow guides can be edge tension wrapped around the central rod 104.

The angle of the protruding guides from the central rod 104 can also be adjusted. In other words, the angle between the outer surface of the central rod 104 and the top or bottom surfaces of the protruding helical guide can be 90 degrees when the protruding helical guide protrudes perpendicularly from the outer surface of the central rod 104. In examples, the angle of the protruding helical flow guides could be between 10 degrees to 170 degrees when measured from the side of the central rod 104. In some embodiments, the angle of the protruding helical flow guides is between 40 and 140 degrees. In some embodiments, the depth of the protruding helical flow guides can be modified. For a non-limiting example, the depth of the protruding helical flow guides can be between 0.3 mm to 100 mm.

The cap 106 can be of the same or different material as the central rod 104. As used herein, "cap" refers to an end section of the central rod or a material that is added to the central rod 104 that blocks flow of a fluid from entering the central rod 104. In an embodiment where the central rod 104 is solid, the "cap" may be an additional piece that is added onto the central rod 104, or may be the end of the central rod 104 that is left flat, or is formed into a shape such as a cone. That is, the cap 106 can be intrinsic to the central rod 104 (the cap 106 may be formed from the central rod 104) or can be initially separate from and then attached to the central rod 104 (extrinsic). In an embodiment where the central rod 104 is hollow, the cap 106 can also be intrinsic to the central rod 104 or attached to the central rod 104 (extrinsic), as described above. For example, in one embodiment of a hollow central rod 104, the end of the central rod 104 may be tapered off to form a closed cone on the end. The intrinsically formed closed cone would fall under the definition of a "cap," as used herein. In one embodiment of a solid central rod 104, the central rod may be left cylindrical, and an end of the cylinder would be considered the "cap" even though no modifications have been made to the cylindrical central rod, as no fluid would be able to flow into the central rod itself due to its solid nature. In embodiments, the cap 106 is made of materials that can withstand temperatures of up to 800 degrees F., 900 degrees F., 1000 degrees F., 1200 degrees F., or more than 2000 degrees F. In embodiments, the material the cap 106 is made from is metal, alloy, or a nonmetal, as long as the material grade complies with the operating temperature requirements. In some embodiments, the cap 106 is made of tungsten, dupex stainless steel, 444, 439, 304 stainless steel high temperature alloy, high temperature polymers, or high performance plastics such as PE or PEI. In some embodiments the cap 106 is symmetric. In some embodiments, the cap 106 is flat, pyramid shaped, cone shaped, or comprises ridges that are contoured to match up to each of the helical flow guides. The presence of the cap 106 on the central rod 104 helps direct fluid into the chambers formed by the protruding helical flow guides and prevents fluid from flowing into the central rod 104 when it is hollow. In a hollow central rod 104, the end opposite the cap 106 of the HX insert 102 can also be blocked, such as by using another cap, or it can be left open.

The HX tube 100 into which the HX tube insert 102 is installed can be any type of HX tube used in a fuel fired application. For example, the HX tube 100 can be used in a fuel fired water heater or a furnace. The HX tube 100 can be straight, include bends, or can be partially dimpled or likewise modified, as long as the portion of the HX tube that the HX tube insert 102 sits in is straight and undimpled. When used here, the length of a HX tube 100 refers to the full length of the HX tube 100 including any dimpled, bent, or additional straight sections.

The HX tube insert 102 is typically inserted such that the end of the central rod 104 on the opposite end of the end comprising the cap 106 is located at or near an end of the heat exchanger tube 100. The HX tube insert 102 does not extend the full length of the HX tube 100, and instead extends less than 90%, less than 80%, less than 70%, less than 60%, less than 50%, less than 40%, less than 30%, less than 20%, or less than 10% the length of the HX tube 100. The length of the HX tube insert 102 can be engineered such that the pressure drop is within acceptable limitations but the HX tube insert 102 is long enough to allow the efficient extraction of heat from fluids that have been already partially cooled within the section of the HX tube 100 that does not comprise the HX tube insert 102. In some embodiments, the length of HX tube 100 that does not comprise the HX tube insert 102 is at least 5 times the length of the HX tube 100 diameter.

Figure 2:
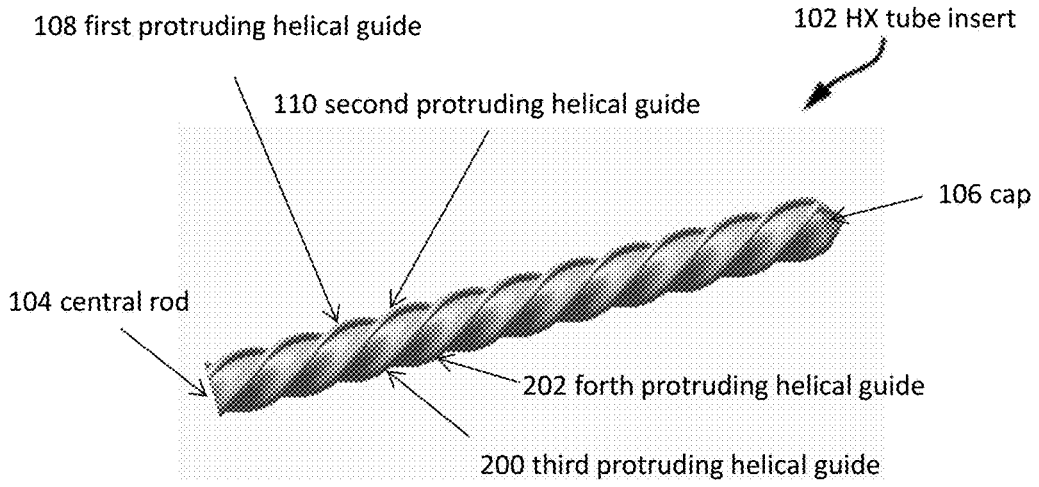
FIG. 2 is a side view of a HX tube insert.
Figure 3:
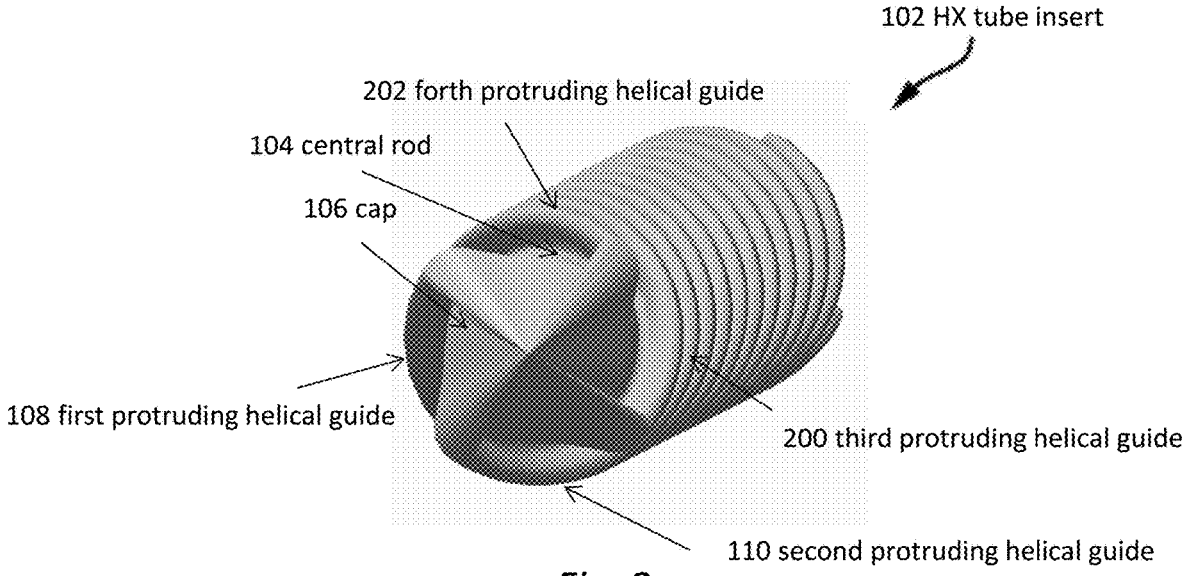
FIG. 3 is a front view of a HX tube insert.

FIG. 2 illustrates an example of a HX tube insert 102 with first protruding helical guide 108, second protruding helical guide 110, third protruding helical guide 200, and forth protruding helical guide 202 that were formed from the central rod 104. FIG. 3 is a front view of the example HX tube insert 102 from FIG. 2. The cap 106 is contoured such that it comprises ridges that match up to each of the helical guides.

Figure 4:
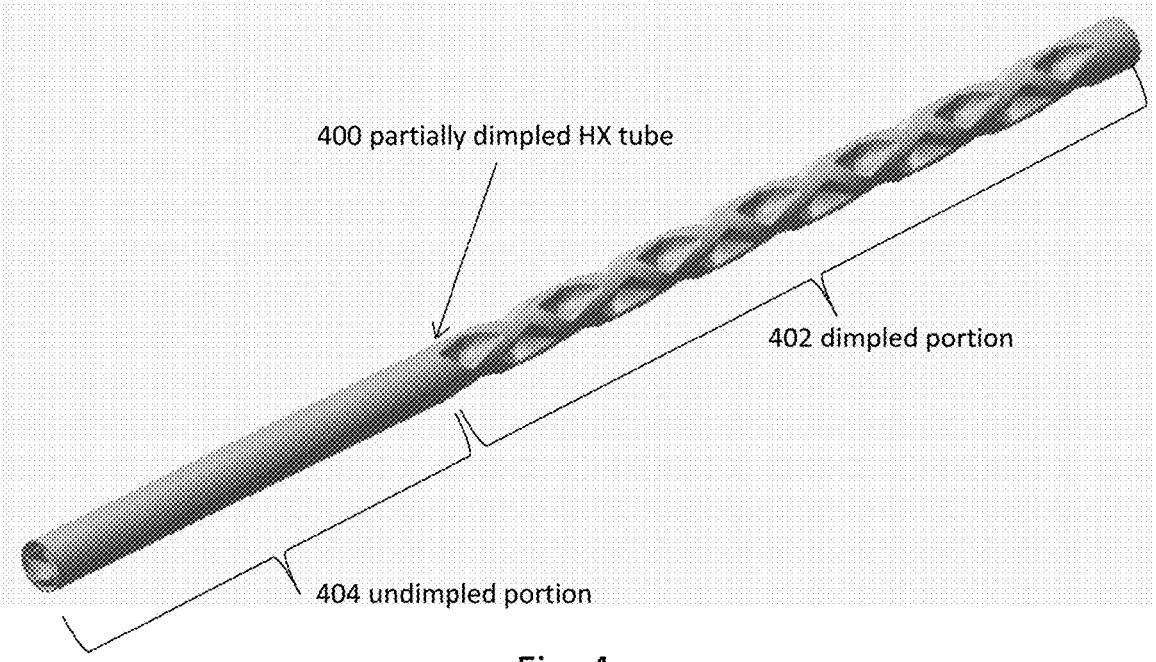
FIG. 4 is a side view of a partially dimpled HX tube.
Figure 5:
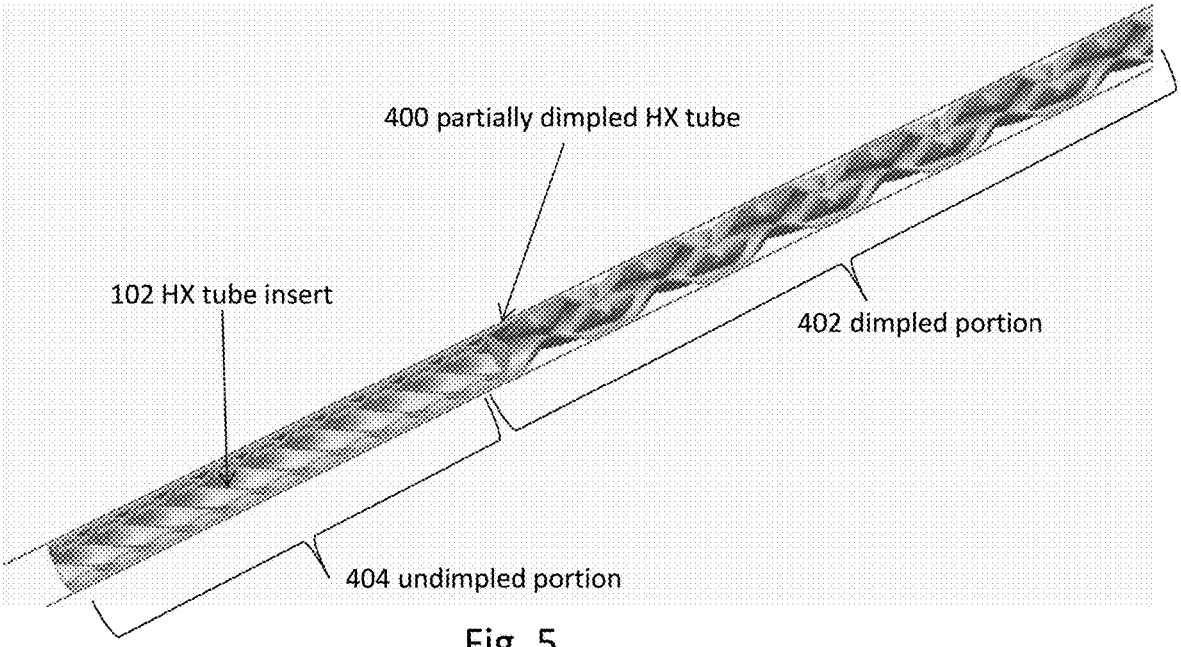
FIG. 5 is a cross section of a partially dimpled HX tube with a HX tube insert in the undimpled section.

FIG. 4 illustrates an example of a partially dimpled HX tube 400 comprising a dimpled portion 402 and an undimpled (cylindrical) portion 404. A HX tube insert 102 can be installed in the undimpled portion 404. FIG. 5 shows a cross section of the partially dimpled HX tube 400 with the HX insert 102 installed in the undimpled portion 404 of the partially dimpled HX tube 400. When installed in a heat exchanger, the heated working fluid flows into the dimpled portion 402 which creates turbulence within the working fluid allowing efficient extraction of thermal energy from the heated working fluid into the fluid flowing outside of the HX tube. The relatively cooler heated working fluid then flows into the voids formed between the protruding helical guides of the HX tube insert 102 and flows around the central rod in a helical manner guided by the protruding helical flow guides. The residence time of the relatively cooler heated working fluid is increased, as is the amount of relatively cooler heated working fluid that contacts the inner circumference of the HX tube 100, thus, more efficiently extracting heat from the relatively cooler heated working fluid.

Figure 6:
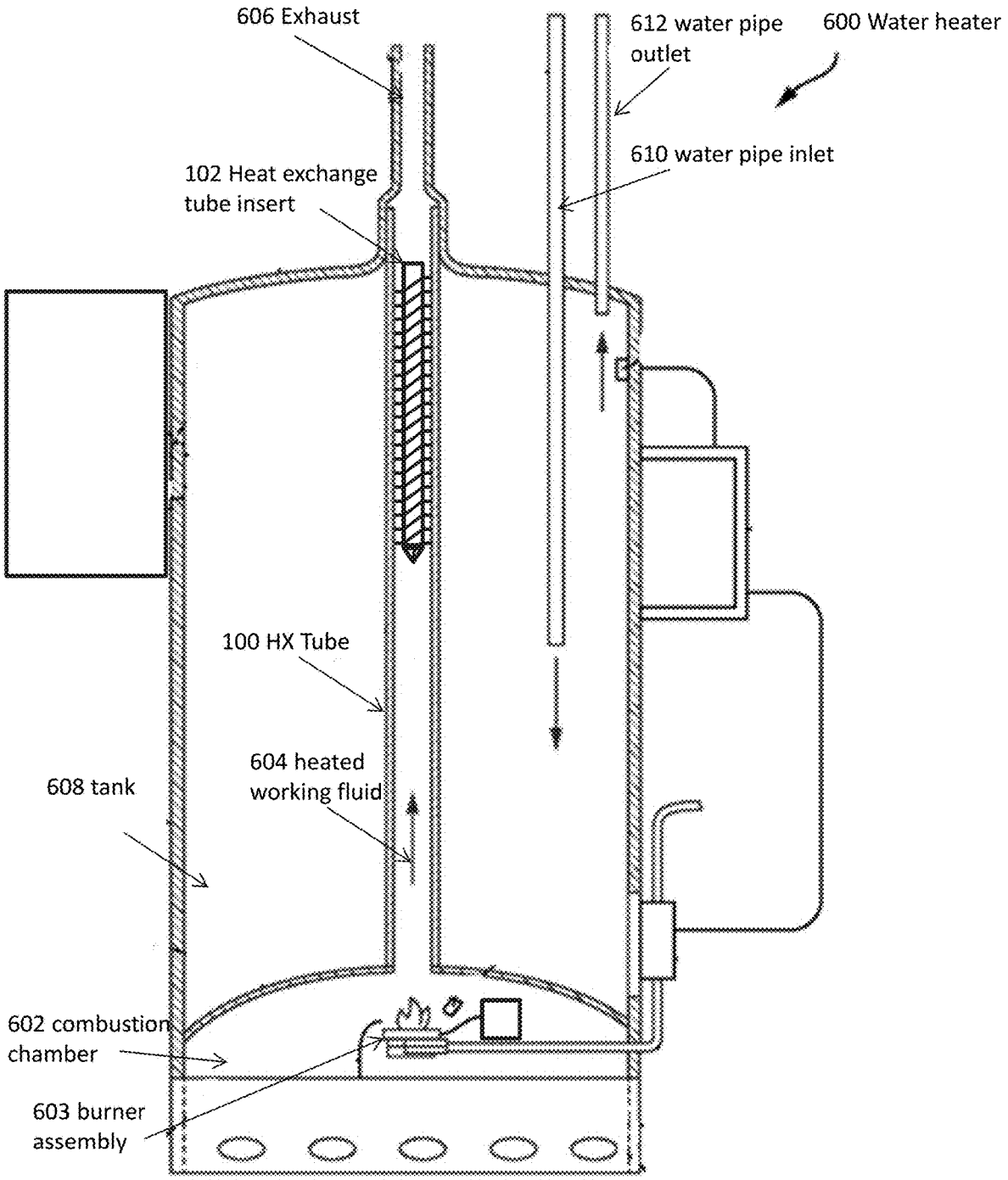
FIG. 6 is a fuel fired water heater with a HX tube insert installed in the HX tube.

FIG. 6 illustrates a fuel-fired water heater 600 with a HX tube insert 102 installed in a HX tube 100. Fuel is fired in a combustion chamber 602 by a burner assembly 603 creating a heated working fluid 604 which rises into the HX tube 100. The HX tube insert 102 is located within the HX tube 100 and directs the heated working fluid 604 around the inner circumference of the HX tube 100. The heated working fluid 604 then exits the water heater 600 through an exhaust 606. Within the water heater 600, the HX tube 100 transfers heat from the heated working fluid 604 into water that is located within a tank 608 of the water heater, therein heating the water. Water enters the tank from a water pipe inlet 610 and heated water exits the tank through a water pipe outlet 612.

Figure 7:
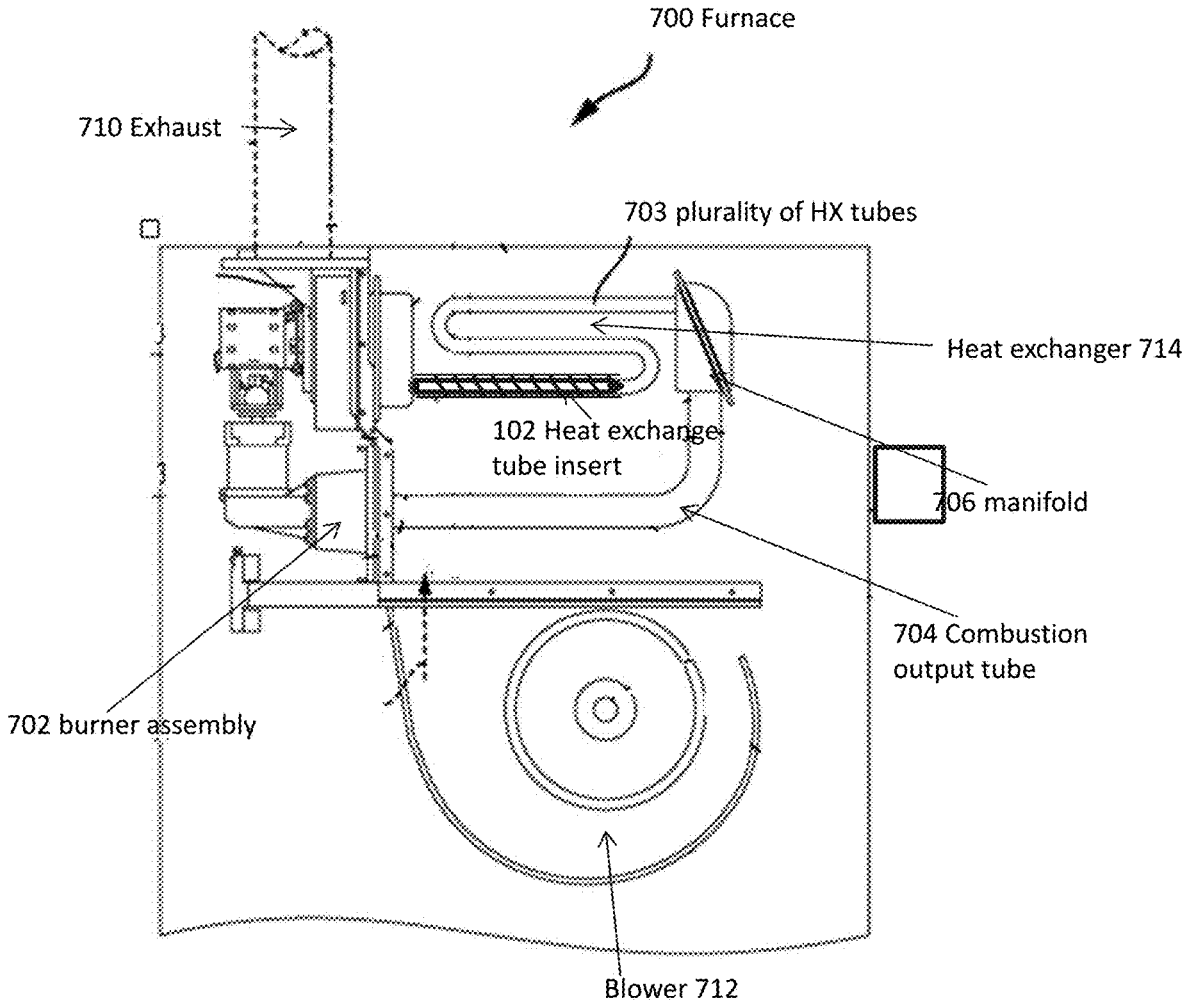
FIG. 7 is a fuel fired furnace with a HX tube insert installed in a HX tube.

FIG. 7 illustrates a fuel-fired furnace 700 with a HX tube insert 102 installed in each of a plurality of HX tubes 703 (only one HX tube is visible in the side view provided in FIG. 7). Fuel is fired in a burner assembly 702 and heated working fluid from the burner assembly 702 flows into a combustion output tube 704. From there the heated working fluid flows into a manifold 706 and then into a plurality of heat exchanger tubes 703. Each HX tube of the plurality of heat exchanger tubes 703 comprises a HX tube insert 102 located closest to the exhaust 710 end of the heat exchanger tube. After flowing through the plurality of HX tubes 703 the now cooler heated working fluid exits the furnace 700 through the exhaust 710. Air to be heated is pushed through the furnace through the use of a blower 712 and exits the heat exchanger 714 as heated air.

HX tubes with the HX tube inserts 102 of the disclosure result in increased efficiency and improved heat transfer, without negatively effecting pressure drop or causing turbulence. For example, it is estimated that example HX tubes comprising the HX tube inserts 102 could increase efficiency by 0.2-2%.

By carefully engineering the various characteristics of the HX tube insert in a HX tube and engineering the positioning and variables of the inserts the flow of working fluid inside the HX tubes 100 can become more efficient, providing a number of benefits, including but not limited to lower blower watts, lower fuel consumption, lower costs, less residual stress, more realisable HX tubes due to not having alterations on tube surfaces, and less waste. For example, embodiments of the disclosure extend the overall travel length and residence time of the working fluid in relatively lower temperature areas of the HX tube where it is harder to extract heat from the relatively cooler working fluid. Example HX tube inserts of the disclosure can also create a significantly reduced pressure drop compared to a turbulator in the heat exchanger as the rotation of the fluids around the fluid flow guides is in a singular direction. Example HX tube inserts can further allow a heat exchanger to comply with any applicable standards and/or regulations. Example embodiments can be mass produced or made as a custom order.

Accordingly, many modifications and other embodiments set forth herein will come to mind to one skilled in the art to which example HX tube inserts pertain having the benefit of the teachings presented in the foregoing descriptions and the associated drawings. Therefore, it is to be understood that example HX tub inserts are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A heat exchanger tube comprising:

a first dimpled portion;

a second undimpled portion; and a heat exchanger tube insert positioned within the second undimpled portion of the heat exchanger tube, wherein the heat exchanger tube insert comprises:

a central rod;

a cap covering one end of the central rod and comprising a first ridge and a second ridge;

a first protruding guide positioned helically around an outer surface of the central rod and extending a full width of an annulus between the central rod and an inner surface of the heat exchanger tube, the first protruding guide being aligned with the first ridge; and a second protruding guide positioned helically around the outer surface of the central rod and extending the full width of the annulus between the central rod and the inner surface of the heat exchanger tube, the second protruding guide being aligned with the second ridge.

2. The heat exchanger tube of claim 1, wherein the heat exchanger tube insert comprises at least three protruding guides.

3. The heat exchanger tube of claim 1, wherein a length of the heat exchanger tube insert is less than 90%, less than 80%, less than 70%, less than 60%, less than 50%, less than 40%, less than 30%, or less than 20% of a length of the heat exchanger tube.

4. The heat exchanger tube of claim 1, wherein the first protruding guide and the second protruding guide are integral to the heat exchanger tube insert.

5. The heat exchanger tube of claim 1, wherein the first protruding guide and the second protruding guide are attached to the heat exchanger tube insert.

6. The heat exchanger tube of claim 1, wherein the cap is integral to the central rod.

7. The heat exchanger tube of claim 1, wherein the cap is attached to the central rod.

8. The heat exchanger tube of claim 1, wherein a diameter of the central rod is greater than half an inner diameter of the heat exchanger tube.

9. A fuel-fired water heater comprising:

a water tank;

a burner assembly configured to generate a heated working fluid;

a heat exchanger positioned in the water tank, the heat exchanger comprising:

a heat exchanger tube including a first dimpled portion and a second undimpled portion, wherein the heat exchanger tube is configured to receive the heated working fluid from the burner assembly; and a heat exchanger tube insert positioned within the second portion of the heat exchanger tube comprising:

a central rod;

a cap covering one end of the central rod and comprising a first ridge and a second ridge;

a first protruding guide positioned helically along an outside of the central rod and which extends a full width of an annulus between the central rod and an inner surface of the heat exchanger tube, the first protruding guide being aligned with the first ridge; and a second protruding guide positioned helically around the outer surface of the central rod and extending the full width of the annulus between the central rod and the inner surface of the heat exchanger tube, the second protruding guide being aligned with the second ridge; and an exhaust configured to receive the heated working fluid from the heat exchanger tube.

10. The fuel-fired water heater of claim 9, wherein the cap of the central rod is located on an end of the central rod which is closest to the burner assembly.

11. The fuel-fired water heater of claim 9, wherein a length of the central rod is less than 90%, less than 80%, less than 70%, less than 60%, less than 50%, less than 40%, less than 30%, or less than 20% of a length of the heat exchanger tube.

12. The fuel-fired water heater of claim 11, wherein the central rod is positioned within the heat exchanger such that one end of the central rod abuts an end of the heat exchanger tube which is closest to the exhaust.

13. The fuel-fired water heater of claim 11, wherein a length of the heat exchanger insert is less than the length of the heat exchanger tube minus five times the diameter of the length of the heat exchanger tube.

14. A fuel-fired furnace comprising:

a fuel source;

a burner assembly configured to generate a heated working fluid;

a heat exchanger comprising:

a heat exchanger tube including a first dimpled portion and a second undimpled portion, wherein the heat exchanger tube is configured to receive the heated working fluid from the burner assembly; and a heat exchanger insert positioned within the second portion the heat exchanger tube comprising:

a central rod;

a cap covering one end of the central rod and comprising a first ridge and a second ridge;

a first protruding guide positioned helically along the outside of the central rod and extending a full width of an annulus between the central rod and an inner surface of the heat exchanger tube, the first protruding guide being aligned with the first ridge; and a second protruding guide positioned helically along the outside of the central rod and extending the full width of the annulus between the central rod and the inner surface of the heat exchanger tube, the second protruding guide being aligned with the second ridge;

a fan positioned to move air over an outer surface of the heat exchanger tube; and an exhaust configured to receive the heated working fluid from the heat exchanger tube.

15. The fuel-fired furnace of claim 14, wherein the cap of the central rod is located on an end of the central rod which is closest to the burner assembly.

16. The fuel-fired furnace of claim 14, wherein a length of the central rod is less than 90%, less than 80%, less than 70%, less than 60%, less than 50%, less than 40%, less than 30%, or less than 20% of a length of the heat exchanger tube.

17. The fuel-fired furnace of claim 16, wherein the central rod is positioned within the heat exchanger such that one end of the central rod abuts an end of the heat exchanger tube which is closest to the exhaust.

18. The fuel-fired furnace of claim 16, wherein a length of the heat exchanger insert is less than the length of the heat exchanger tube minus five times the diameter of the length of the heat exchanger tube.

19. The fuel-fired furnace of claim 14, wherein the heat exchanger insert comprises at least three protruding guides positioned helically along the outside surface of the central rod.

* * * * *